United States Patent [19]

McLoughlin

[11] 4,189,005

[45] Feb. 19, 1980

[54] FIRE TRUCK CONTROL MEANS

[76] Inventor: John McLoughlin, 92 Mobrey La., Smithtown, N.Y. 11787

[21] Appl. No.: 849,039

[22] Filed: Nov. 7, 1977

[51] Int. Cl.[2] ..... A62C 27/18

[52] U.S. Cl. ..... 169/24; 169/13; 239/148

[58] Field of Search ..... 169/13, 24, 25; 251/89, 251/90, 294; 137/272, 291; 239/74, 148; 192/0.02 R, 89 R

[56] References Cited

U.S. PATENT DOCUMENTS

| | | | |
|---|---|---|---|
| 1,898,242 | 2/1933 | Chandler | 251/89 X |
| 3,162,794 | 12/1964 | Whitaker | 192/0.02 R X |
| 3,786,869 | 1/1974 | McLoughlin | 169/24 |
| 3,977,605 | 8/1976 | Sheldon | 239/74 X |
| 3,981,618 | 9/1976 | Nelson, Jr. | 169/24 X |

*Primary Examiner*—Robert B. Reeves
*Assistant Examiner*—Andres Kashnikow
*Attorney, Agent, or Firm*—James P. Malone

[57] ABSTRACT

Fire fighting system for communication and control of fire fighting equipment, such as maintaining the pressure and providing various warnings of different situations which may arise which cause a decrease in the fire fighting capability of the apparatus and personnel. A transceiver is provided with an audible tone output to serve as a warning device for the nozzle men. An improved clutch drive system automatically operates the control valves thereby eliminating the need for stop switches on the various valves.

15 Claims, 18 Drawing Figures

FIRE TRUCK CONTROL MEANS

This invention relates to fire truck control means and more particularly to means for controlling all of the fire fighting facilities at the scene of a fire.

This Application is an improvement of my U.S. Pat. No. 3,786,869, granted Jan. 22, 1974, for NOZZLE PRESSURE CONTROL SYSTEM. That patent provided improvements in regulating the nozzle pressure of fire hoses being used at a fire. That patent also disclosed means for the men holding the hose nozzles to communicate with the fire chief or other control officer and with the fire truck operators.

There is much room for improvement in the fire fighting field especially in the areas of communication and control of fire fighting equipment such as maintaining the pressure and indicating various warnings of and correcting different situations which may arise which cause a decrease in the fire fighting capability of the apparatus and personnel.

The present invention provides improved communication between the nozzle men and the control center which may be on the fire truck. The nozzle men will carry a transceiver with an audible tone output to serve as a warning device for the nozzle men. The present invention also provides an improved clutch drive system for operating the control valves. The clutch system of the present invention eliminates the need for stop switches on the various valves. New and improved pressure regulating means are provided for maintaining pressure on the hoses. A new and improved low hydrant pressure control system is incorporated. New and improved means are provided for indicating when a tank is approaching an empty state. New and improved means are provided for remote control of hydrant valves. Means are also provided to coordinate the water pressure from the hydrant with operation of water tank means including means to automatically refill the tanks.

All information and all controls are digitalized. Pressure signals which are analog signals are converted to digital output form. All pressures and all flows are used to control the engine speed which provides the pump pressure. Means are also provided to monitor the operation of the carburetor to better control the amount of fuel being supplied to the engine to thereby control the amount of fuel being supplied to the engine to thereby control the engine speed and the pressure.

Accordingly, a principal object of the invention is to provide new and improved fire fighting means.

Another object of the invention is to provide new and improved fire truck control means.

Another object of the invention is to provide new and improved means to monitor the inputs to the fire fighting apparatus and control them for maximum efficiency.

Another object of the invention is to provide new and improved fire fighting communication and control means for fire trucks having tanks and a driven pump for supplying water to hoses and nozzles comprising, a nozzle mounted transceiver with an audible tone output to serve as a warning device for the nozzle men, automatic clutch drive means for operating hose control valves, and automatic pressure regulating means connected to the pump for maintaining pressure on the hoses.

These and other objects of the invention will be apparent from the following specification and drawings of which:

Figure 1:
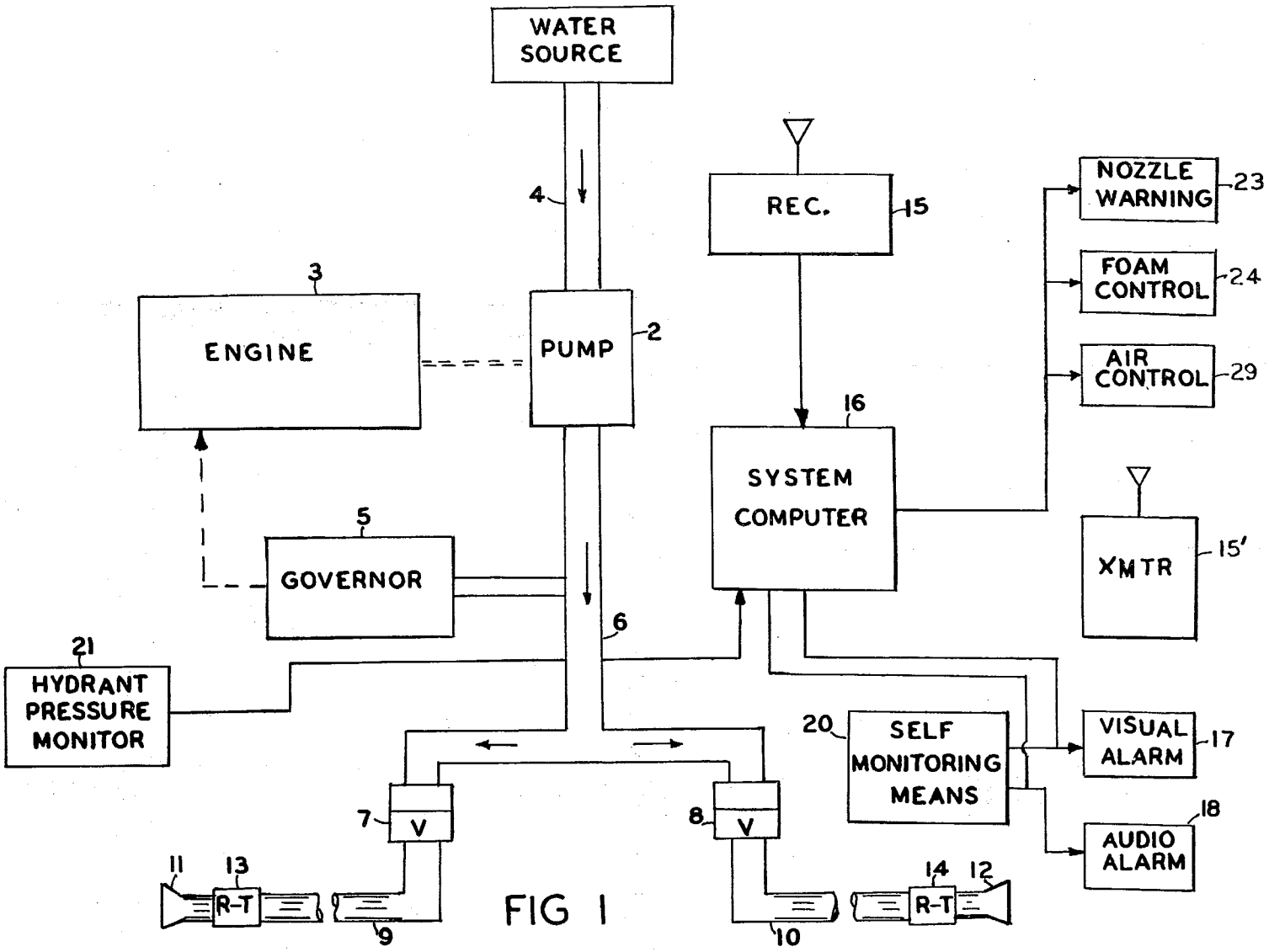
FIG. 1 is a schematic block diagram of an embodiment of the invention.

FIG. 1 shows a schematic block diagram of the nozzle pressure control system. The truck engine 3 is mechanically connected to drive the pump 2. The pump 2 is connected to a source of waters through the pipe 4. The pressure is controlled by means of the governor 5 which is connected to control the engine speed. The output of the pump is connected by means of the pipe 6 to a plurality of valves 7 and 8, each of which is connected to a length of hose 9 and 10. The hose nozzles 11 and 12 have incorporated in them receiver-transmitters 13 and 14, which are adapted to communicate to and from the nozzle men. Signals from the nozzle men and other places are received by a receiver 15 the output of which is fed to a system computer 16. Transmitter 15' is used for general communication.

Other outputs of the computer, as will be explained, are connected to operate visual alarm 17 and audio alarm 18, in the event any dangerous conditions arise. Self monitoring means 20 are also provided to operate the visual alarm and audio alarm 18. The hydrant pressure is also monitored by the hydrant monitor 21 and this information is wired to the system computer.

Other outputs of the computer, as will be explained, include a nozzle men warning system 23, foam controls 24 and breathing air regulator 29. Each nozzle man will carry a transceiver either personally or mounted on the nozzle with an audible tone output as well as a voice output. These channels may be controlled by the truck transmitter and can serve as a warning device for the nozzle men if the pump is about to run out of water or if some other warning is required. The hydrant pressure is monitored at the truck inlet point.

Figure 2:
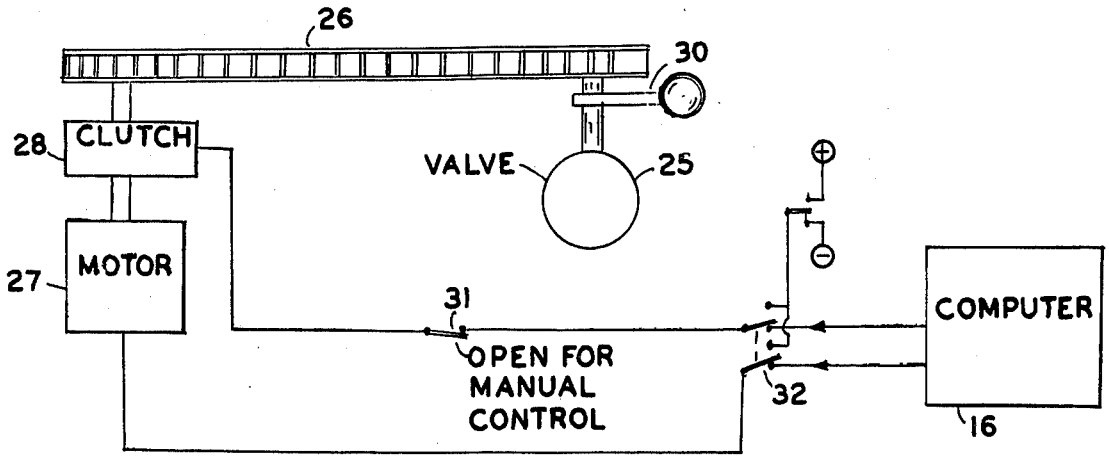
FIG. 2 is a schematic diagram of valve control means.

FIG. 2 shows a clutch drive system for the hose valves. The valve 25 is controlled by the mechanical linkage chain 26, motor 27 and the clutch 28. The manual control handle 30 is also provided to operate the valve if the control system should be disabled. The clutch is controlled from the computer 16 through open-close switch 31 and by-pass switch 32. The purpose of the by-pass switch 32 is to give an electrical switch control over the valve. This switch is on the pump panel.

The control unit of FIG. 2 can be mounted on a hydrant and remotely controlled by wire or radio from a central control station.

This system is designed with electric, pneumatic or hydraulic actuated clutch, such that any time there is a signal for one of the valves to be turned, the clutch will activate for the duration of the turning required, whether it be a full turn, quarter turn, and so forth. One of the benefits of this system is that the clutch will slip when the valves are full open or full closed, eliminating the necessity for stop switches. It also allows 100% manual override capability. All that is necessary, is to disable the clutch system, and push or pull a handle. In an emergency situation, it is not necessary to deactivate the clutch circuit.

Figure 3:
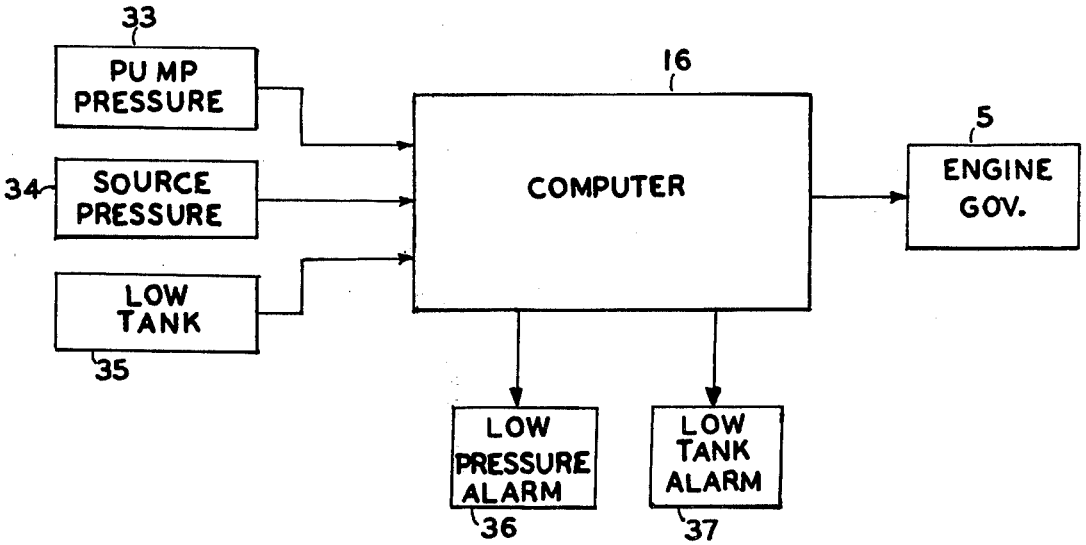
FIG. 3 is a schematic diagram illustrative of the operation of the invention.
Figure 16:
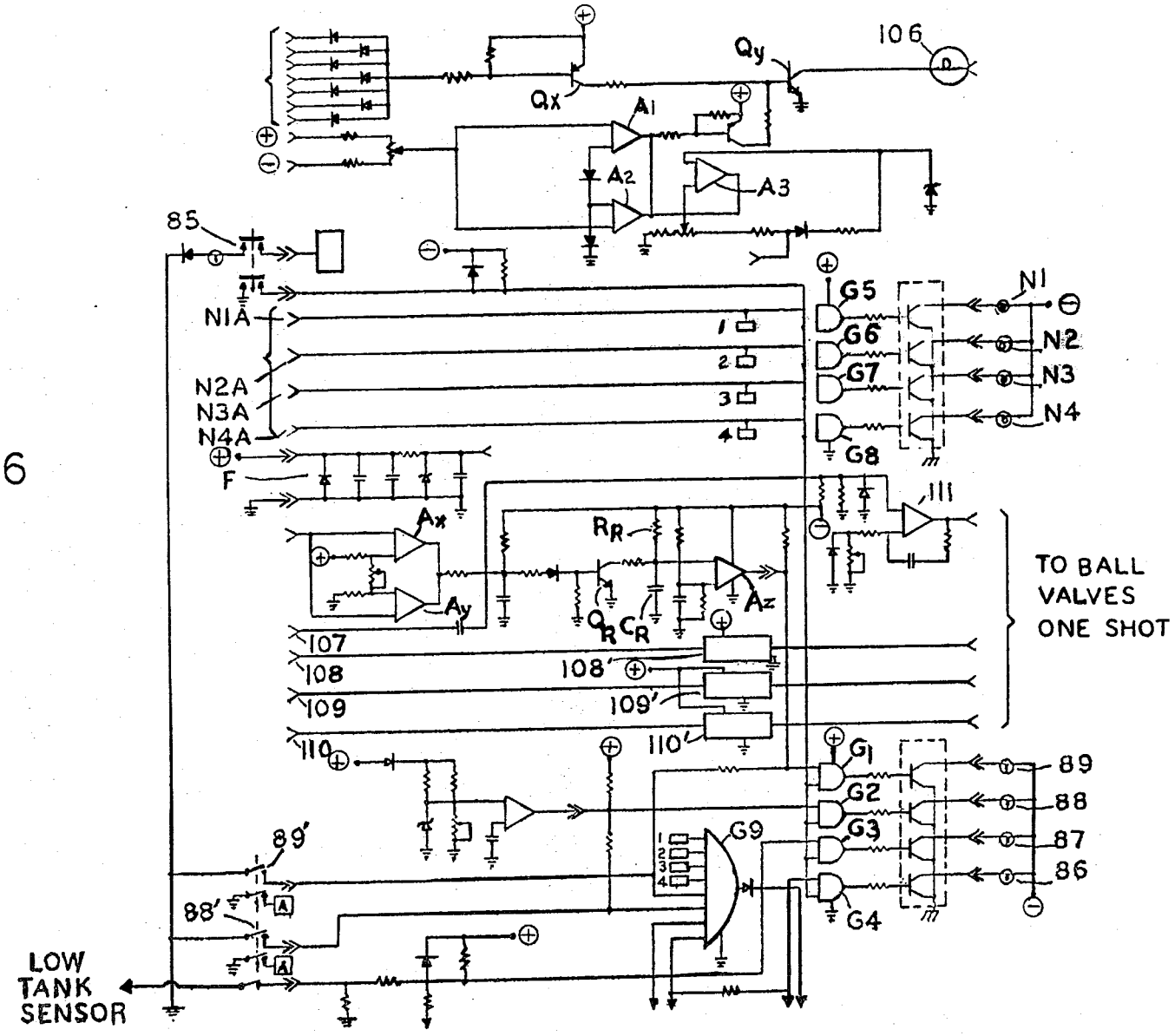
FIGS. 16 and 16A are a schematic circuit diagram of a complete system embodying the invention.

FIG. 3 shows a diagram indicating the inputs and outputs of the central logic computer 16 shown in FIG. 16. Inputs to the computer include pump pressure from the pump pressure sensing transducer 33. The incoming water pressure is sensed by the transducer 34. Tank volume is sensed by transducer 35. One output of the computer controls the engine governor 5. Other outputs are to low pressure alarm 36 and low tank alarm 37.

Figure 4:
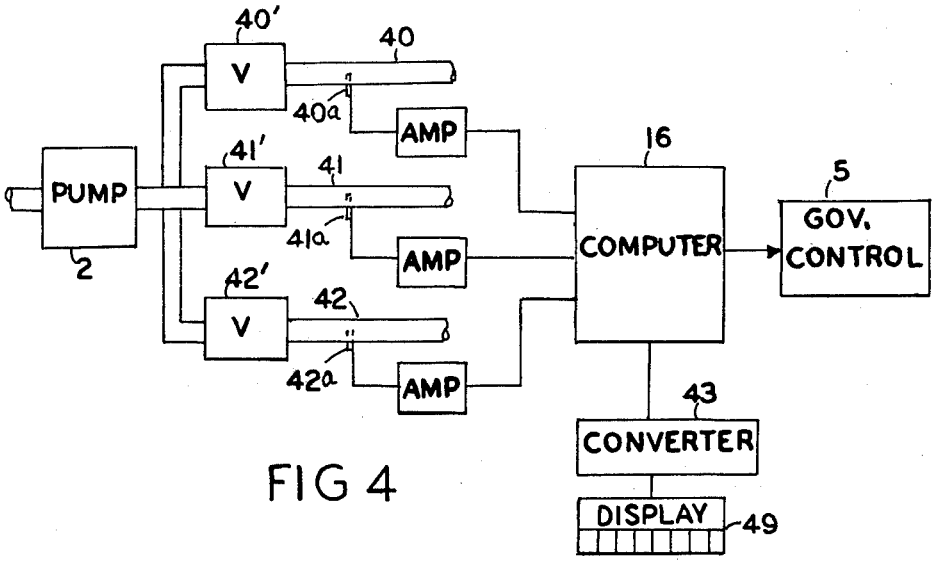
FIG. 4 is a schematic diagram of pressure control means.
Figure 8:
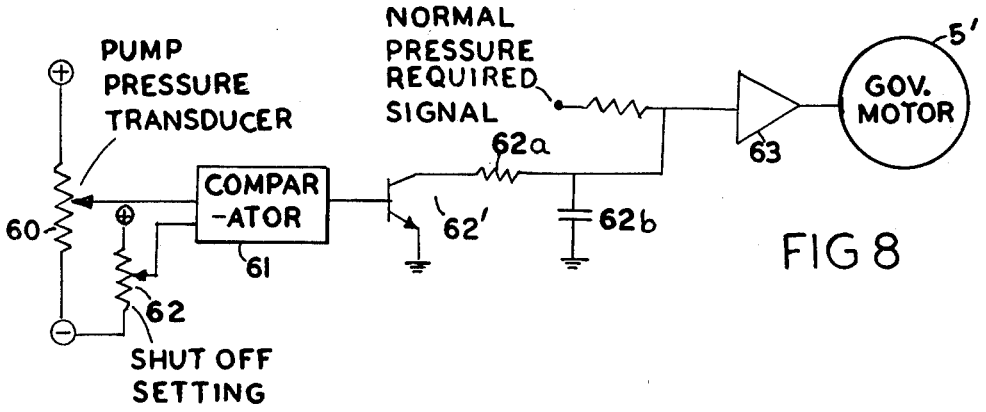
FIG. 8 is a schematic diagram of pressure control means.

FIG. 4 shows a schematic diagram of a hose pressure control system. The pump 2 is connected to the various hoses 40, 41, 42, through the control valves 40', 41', 42'. Signals from flow transducer **40*a*, 41*a*, 42*a*, are fed to the central logic computer 16 which in turn operates the governor 5 circuits for controling the pressure. The pressure information is preferably displayed on a digital display 49 connected to converter 43. The computer 16 may be connected as shown in FIG. 8**.

Figure 5:
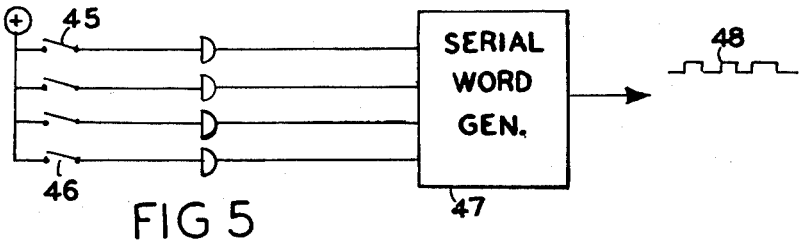
FIG. 5 is a schematic diagram of nozzle transceiver means.

FIG. 5 shows a schematic diagram of a multiple code transmitter of the type which could be used by the nozzle men. A series of switches 45, 46, etc., activates a serial word generator 47 which transmits a series of pulses 48 to the transmitter.

Figure 6:
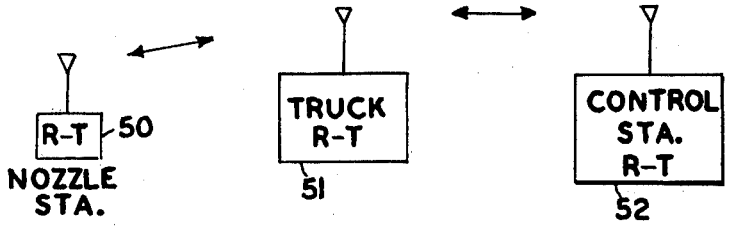
FIG. 6 is a diagram illustrative of the operation of the nozzle transceiver operation.

FIG. 6 shows the chain of communication. Each nozzle man has a receiver transmitter 50. There is also a transmitter receiver 51 on the truck and there may also be a transmitter receiver 52 at a control location, for instance, where there a number of trucks involved in a fire fighting operation, or at fire headquarters. The transmitter is preferably a multiple code transmitter.

Figure 7:
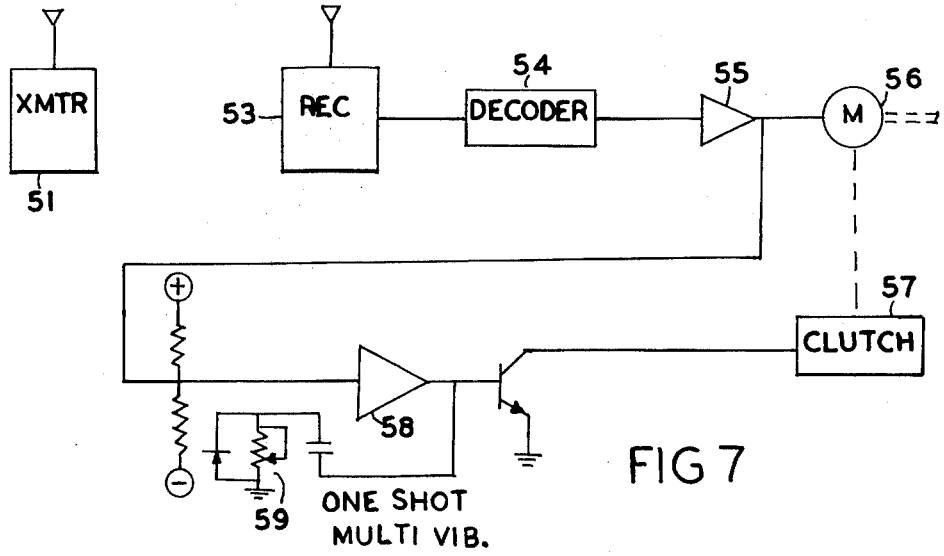
FIG. 7 is a schematic diagram of remote valve control means.

FIG. 7 shows a typical clutch control means for use in the system. Control signals are received by the receiver 53 preferably in digital form and connected through decoder 54 to servo amplifier 55 which controls the motor 56 and operates the clutch 57. The decoder is also connected to an adjustable one shot multivibrator 58 which is adjustable by the potentiometer 59. This system offers the ability to open or close the valve in increments to vary the flow of water or if necessary to open or close the valve completely at one digital command, by varying the time constant of the one shot multi-vibrator 58.

The control means of FIG. 7 may be mounted on a hydrant to open and shut it by the motor 56 operating a valve with remote control.

FIG. 8 shows automatic water pressure regulation means. The governor motor 5' of governor 5, FIG. 1 controls the speed of engine 3 and pump 2, FIG. 1.

FIG. 8 shows a system whereby when the water supply is failing, the governor system shuts down slowly to avoid a system shut down due to minor fluctuation in incoming water pressure. In this system a signal from the pump pressure transducer 60 is fed to a comparator 61 which compares the pressure signal with a desired pressure signal inserted by the potentiometer 62. The output of the comparator is fed through a time delay circuit 62' and then to servo amplifier 63 which controls the governor motor 5'. Resistor **62*a* and capacitor 62*b* has a time delay effect on amplifier 63, causing governor motor 5'** to decrease slowly, thus preventing system shut down for momentary conditions such as if a vehicle drives over a water supply hose.

Figure 9:
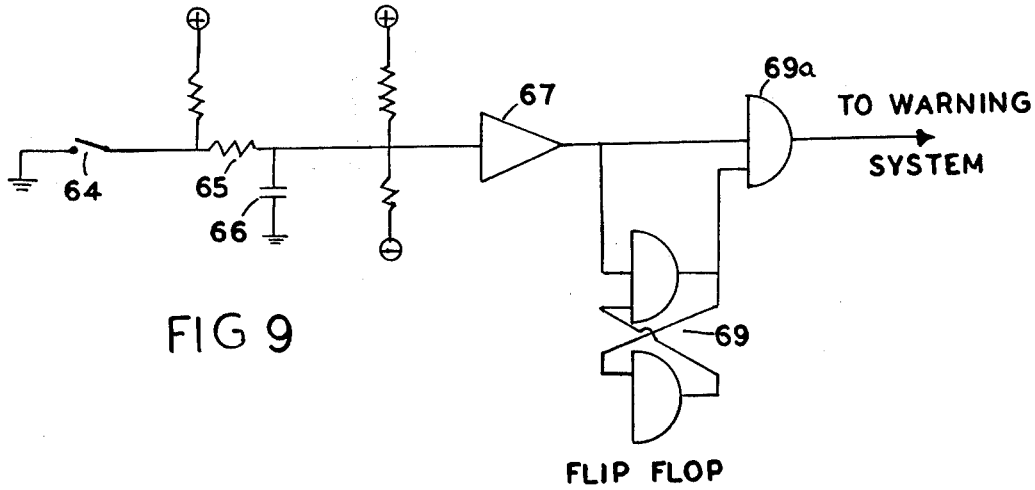
FIG. 9 is a schematic diagram of pressure monitor means with time delay.

FIG. 9 shows a typical means for activating the low pressure warning system. The low pressure signal is fed from the sensor 64 through a time delay circuit 65, 66, to amplifier 67. The output of which is connected to warning devices.

The time delay prevents the warning system from being activated due to momentary fluctuations in the pressure.

The flip-flop circuit 69 holds gate **69*a* on until it is reset. When switch 64 closes the flip-flop is set. When switch 64 opens, flip-flop 69 is reset which causes gate 69*a*** to indicate a warning.

Figure 10:
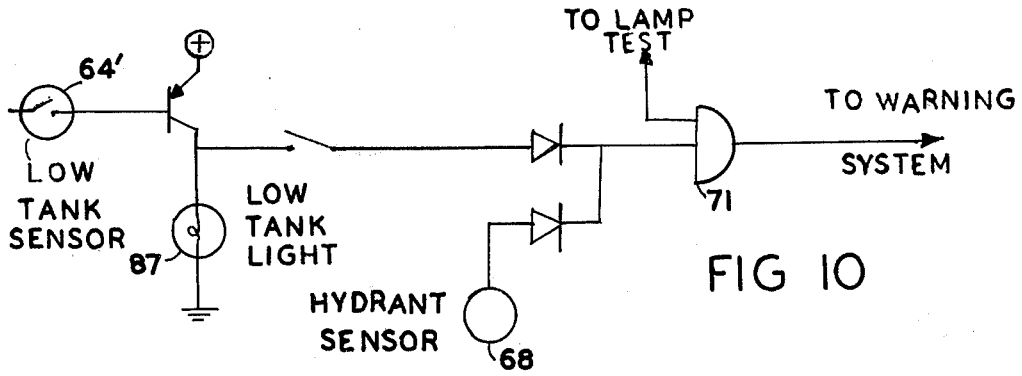
FIG. 10 is a schematic diagram of hydrant pressure sensing means.

The circuit in FIG. 10 receives an indication from a sensor circuit 64' in the tank, that indicates when the tank is approaching an empty state. This can either be an electro-mechanical switch, capacitance indicator, or conductor type circuit. Any time the tank approaches an empty state, or the tank to the pump switch 76' is not opened, a warning bell will sound, indicating that the pump will run out of water, momentarily. This circuit is by-passed as shown in FIG. 10, if there is a hydrant pressure, or if the truck is drafting, by sensor 68. "OR" gate 71 operates for lamp test on low tank sensor.

Figure 11:
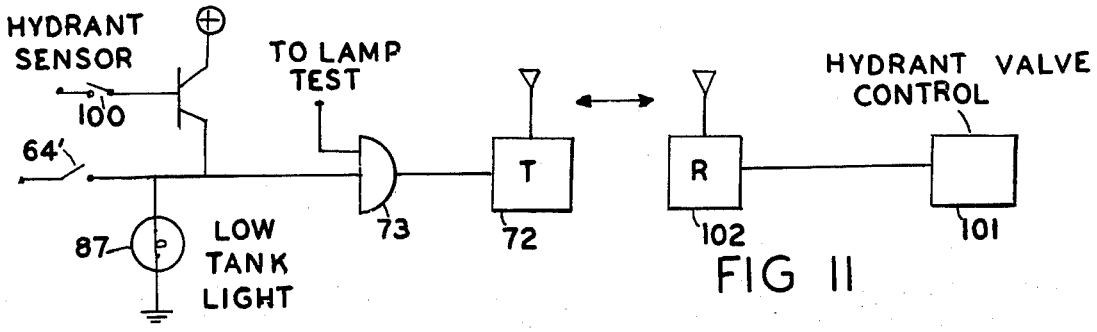
FIGS. 11, 12 and 13, are schematic diagrams of hydrant control means.

In FIG. 11, a transmitter 72 sends a signal from hydrant sensor 100, to the hydrant valve control 101 via receiver 102 at the hydrant causing it to open or close as required. This circuit is activated by gate 73 by control switches on the pump operator's panel, or by a signal from the computer. Gate 73 operates for lamp test or sensor 100.

Figure 12:
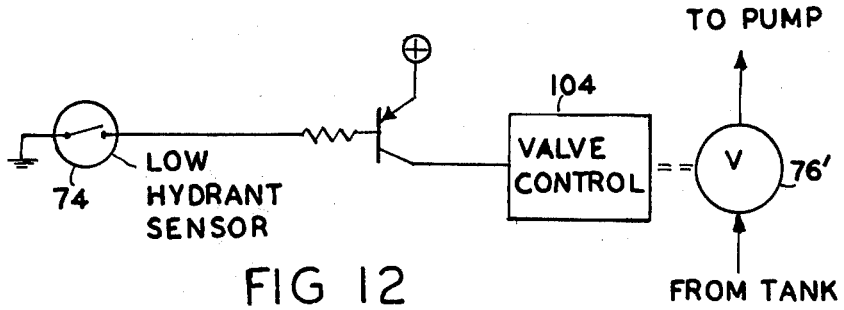

FIG. 12 shows means for opening tank-pump valve 76' by pneumatic, hydraulic or electric means, if the incoming hydrant pressure falls to 0 psi. The hydrant pressure is constantly monitored by sensor 74 and the output fed to the tank to pump valve driving mechanism 104.

Figure 13:
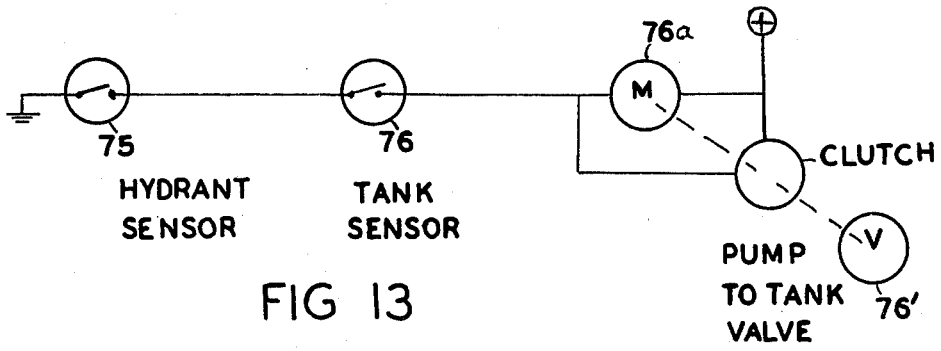

FIG. 13 shows means for automatic refill of the tank. If the tank is less than full, and a pressurized source is obtained a valve from the source will be opened by electric, pneumatic or hydraulic means and this valve will stay opened until the tank is full, at which time the control system will close. Hydrant pressure sensor 75 is connected in series with low tank sensor 76 to control motor **76*a* and pump to tank valve 76'**.

Figure 14:
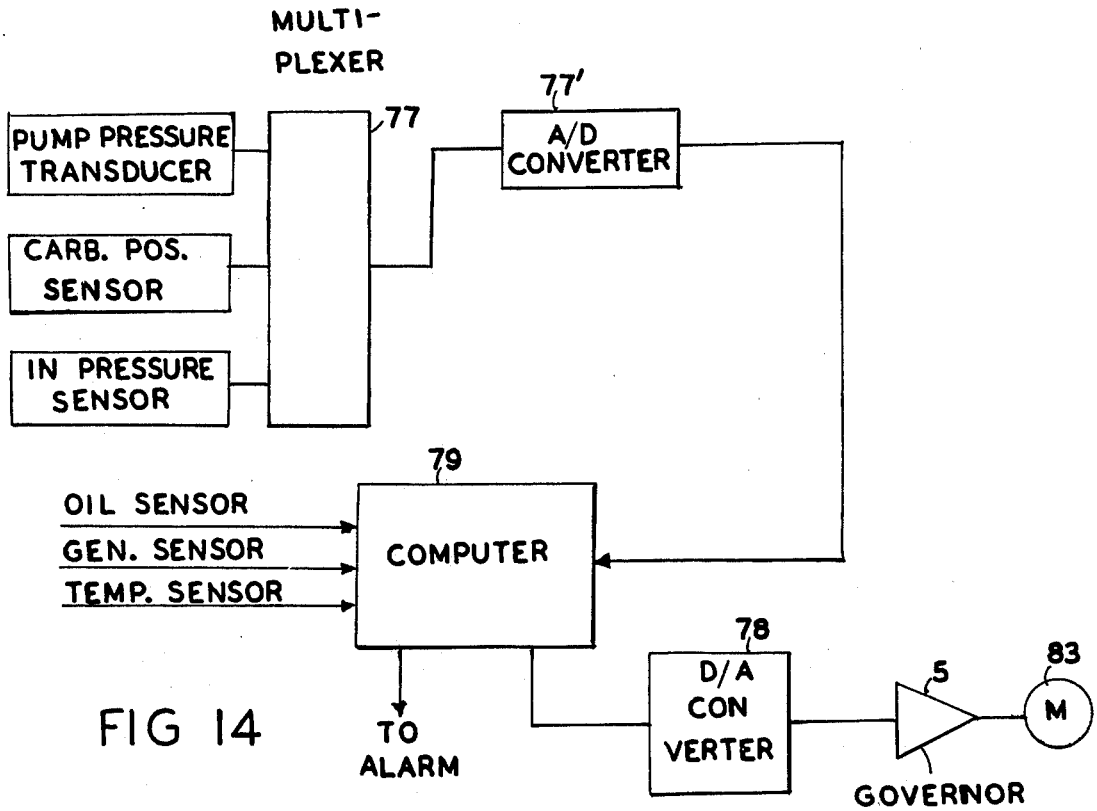
FIG. 14 is a schematic diagram of digital control means.

FIG. 14 shows a typical digital control system. All information and all controls on a system are preferably digitalized. The pump pressure and all flows, which are analog signals from analog transducers are connected through a multiplexer 77 to a conventional analog to digital converter 77'. All computations for Governor speed and valve position are computed by a microprocessor 79. All digital logic and the data is reconverted to analog by D/A converter 78 when necessary, for analog control of the valves and engine speed. The engine speed can be controlled by digital pulses, by varying pulse width, and polarity, by an electric motor 83.

Figure 15:
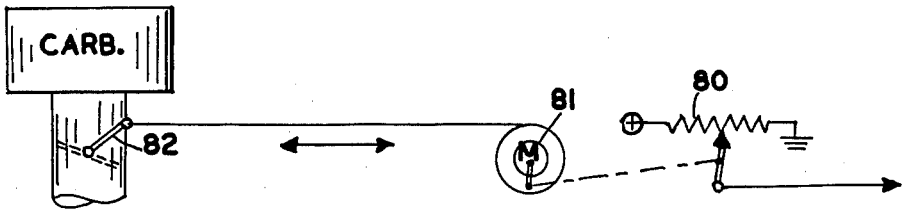
FIG. 15 is a schematic diagram of carburetor monitoring means.

FIG. 15 shows carburetor/fuel rack monitoring system. A positioned transducer shall be mounted on the speed control mechanism, to continually monitor the position of the carburetor and the fuel rack. This information will be sent to the main system computer, enabling the computations to be affected and, thus, better controlled by the amount of fuel being supplied to the engine.

The potentiometer 80 is connected so that as the motor 81 moves the fuel rack 82 of carburetor, a signal proportional to its mechanical position is transmitted to the system computer and this signal is used to monitor system operation.

Figure 16A:
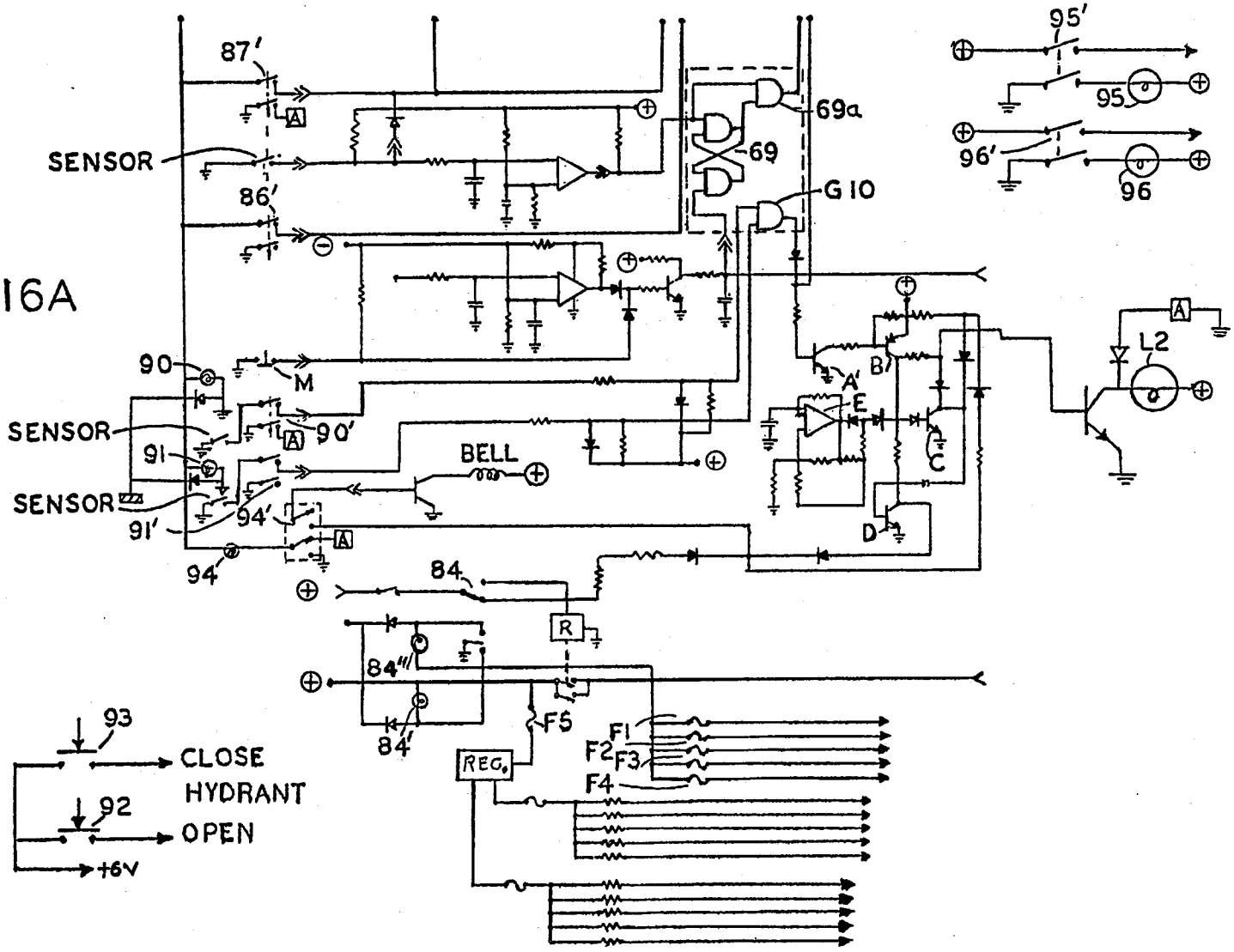
Figure 17:
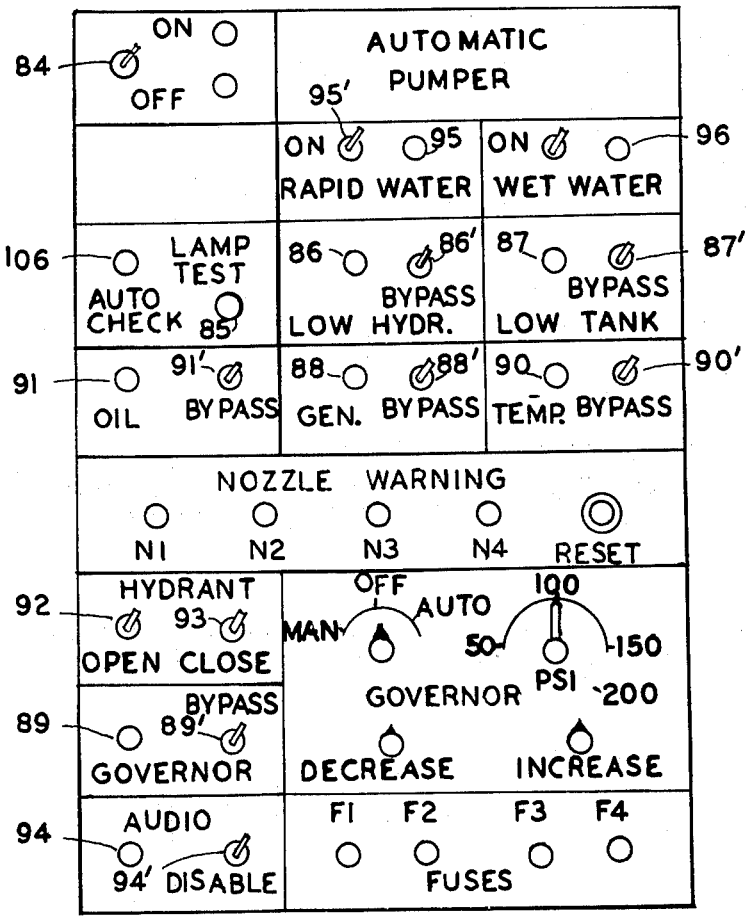
FIG. 17 is a front view of the control panel of the invention.

FIGS. 16 and 16A show a schematic circuit diagram of a system showing how the features of the invention may be used. FIG. 17 shows the control panel.

The upper part of FIG. 16 is an automatic check circuit which automatically checks the fuses and proper voltages and gives an indication on lamp 106. The operation of this circuit is as follows.

If a fuse blows, the load ground energizes $Q_x$ and $Q_y$ and $Q_y$ will turn auto check light on. If the +6V or −6V don't balance equally, $A_1$ or $A_2$ will turn on causing $Q_y$ to turn auto check on. $A_3$ monitors the battery voltage, and turns on $Q_y$ which will turn on auto check lamp 106.

The press to test switch 85, automatically lights all the lights on the panel, FIG. 17, to show that the lights are in proper operation. These lights include the nozzle warning lights N1, N2, N3 and N4, the low pressure warning light 86, the low tank capacity warning light 87, the generator light 88 and the governor light 89, the temperature warning light 90 and the oil pressure warning light 91.

The nozzle warning lights are energized by signals received from the nozzle men on terminals N1A, N2A, N3A and N4A. The filter F provides voltage to the system and eliminates false activation due to noise on line.

Switch 84 is the main on/off switch. The lamp test button 85 automatically turns on all of the control lamps for the purpose of testing the lamps. The warning light 86 indicates low hydrant pressure. The warning light 87 indicates low tank capacity. Both of these controls have bypass push buttons 86', 87', for the purpose of shutting off the audio alarm for each failure.

The oil pressure warning light 91 indicates low oil pressure. The generator warning light 88 indicates low generator voltage.

The temperature warning light 90 indicates unduly high engine temperatures.

The nozzle warnings N1, N2, N3, N4, indicate warnings from the nozzlemen, for instance, if they are not getting enough pressure. The hydrant controls 92, 93, open and close hydrant control circuits. The light 89 indicates out of tolerance pressure of the governor. The audio light 94 indicates operation or bypassing of the audio circuits. The disable switch 94' is used to disable the audio warning.

Replaceable fuses F1, F2, F3 and F4 are provided for easy replacement on the panel.

The rapid water light 95 indicates operation of the rapid water system.

The wet water light 96 indicates operation of the wet water system.

The rapid water and wet water systems are conventional chemical injection water conditioning systems.

On/Off Switch

Red light 84' will be on whenever the On/Off switch 84 is in Off position. If the pump is engaged, and the switch is Off, the light and bell (on the truck) will turn on continuously, indicating to the pump operator that the unit is Off. In the On position, red light 84' is off and green light 84'' on.

Warning Lighs

There are ten Warning Lights.

1. Four Emergency N1 to N4 indicating that a specific nozzleman is in trouble and needs immediate help.
2. Warning for:
   1. High Temperature - 90
   2. Low Tank level - 87
   3. Oil pressure - 91
   4. Low Pressure Hydrant - 86
   5. Generator - 88
   6. Governor - 89

If there is a failure in one of the systems being monitored, the corresponding light comes on, indicating the source of failure. At the same time, the Light/Bell will alternate, giving a visual and audio warning for the fireman. This eliminates the need for a pump operator to stay next to the pumper continuously.

Each of the monitoring devices can be by-passed. This is done to override the audio failure indication. If, after investigation, it was found that the alarm was not caused by any of the above, or can be ignored, the circuit, which is on, can be bypassed. This will turn the Bell off and the Light 94 and L2 on continuously, indicating that one section of the system is being by-passed.

Low Hydrant Sw 86' (Low Pressure) - Low Tank Switch Sw 87'

(FIGS. 16, 16A) When Low Tank warning 87 comes on, the Bell/Light circuit is not activated, since it is not a failure. It is just an indication that water level is low. It will initiate a failure indication if the hydrant pressure is low.

If Low Hydrant light 86 comes on indicating low pressure at the pump, Light/Bell circuit will be activated. A special feature of this circuit is that the low pressure sensor will be ignored by the system at first, when pressure is low. Once the pressure goes up to desired level, only then will the low pressure sensor be active, and will monitor a failure in pressure.

Flip flop 69 will change state when pressure changes from zero to desired level. Only then will it enable gate **69*a*** to sense the other input switch in low pressure sensor input.

Master Reset Switch—M—FIG. 16A

Switch M resets the radio section enabling a new input from the nozzleman, as well as the hydrant circuit 69.

Governor Warning —Ax, Ay, Ax—FIG. 16

The Governor Warning circuit monitors the difference between the actual pressure and the desired pressure. If the difference is greater than ±20 psi, the Governor light 89 will come on, via NAND gate G1 and the light and the bell circuit will be activated. This circuit has a time delay, Rr, Cr, Qr, to allow the governor to reach the desired pressure without warning. Once it gets there, the right pressure is monitored without any delay.

Auto Check Light—106—FIG. 16

Light 106 will be on whenever there is power failure to the fused section of the system, the sections are:

1. Ball Valve Fuses F1 to F4 (fuse check inputs)
2. Governor Fuse (fuse check input) $F_g$
3. If +6V or −6V failed, amplifiers A1 or A2 are activated.
4. Receiver Fuse F5 (fuse check input).
5. Low Battery amplifier A3 is activated.

This circuit will not activate the Light/Bell circuit. It is a visual indication for the operator when the unit is turned on.

The inputs to AND gate G9 are connected to nozzle warning lines, N1A, N2A, N3A and N4A via the terminals labeled 1, 2, 3 and 4. The other inputs are from the generator by-pass or disable circuit, low tank by-pass or disable circuit and low input pressure by-pass or disable circuit. If any input is switched to logical 0 the output of G9 is logical 1 which actuates the bell and light circuits.

To by-pass any sensor warning so as to turn off the bell and light circuits the particular by-pass switch is changed to logical 1 which will change the output of G9 to logical 0 which deactivates the bell and light circuits but will not effect the warning lights which will remain on.

Square wave of oscillator E provides a square wave WH1 a period of approximately three seconds.

When the input to transistor A' is logical 1, transistor A is switched on causing transistor B to turn on and provide 12 volts to its collector.

If the output of square wave generator E is 0 then transistor C is off allowing 12 volts from the collector of transistor B to be connected through resistor F to turn on the light L2.

At the same time since transistor C is off, transistor D will be on which will keep the bell circuit off.

If the output of square wave generator E is logical 1 then transistor C is on, shorting the input of the light L2 to ground and at the same time switching off transistor D so that 12 volts is provided to the bell circuit. Therefore the square wave circuit continuously alternates the bell and the light until the output of the gate G9 becomes logical 0.

Gate 10 is a NAND gate which is in parallel with and in effect an extension of gate G9 for the temperature and oil sensor circuits.

Signals to control the ball valves for the hoses are received on terminals 107 to 110. The signal on terminal 107 is fed to a single shot multi-vibrator circuit 111, the output which is connected to the ball valves control circuits shown in FIG. 2. The signals for the hose on terminals 108, 109 and 110, are connected through similar single shot multi-vibrator circuits 108', 109' and 110'.

The Governor can be operated in the manual or in the automatic mode. In automatic, the pressure that is dialed in, is reached within ten seconds, and is held within seven (7) psi of the desired pressure. It is the fastest, and most accurate Governor system available.

If the pump runs out of water, the alarm system will sound, and the engine RPM will slowly decrease to an idle. If a second water source is obtained, or the water pressure increases, the pump will resume its normal operation, and the warning will be cancelled.

If the Governor cannot reach and maintain the desired pump pressure, due to a lack of water, etc., within 15 seconds the Governor warning light will come on, and the alarm system will be activated.

This alarm system is also activated, if the Governor is inadvertently left in the Off or the Manual position.

The audio alarm portion can be by-passed, by depressing the Governor By-Pass switch.

This system is designed to make it simpler for a fire department to hit the fire with as much water as possible, as quickly as possible, and in addition, it gives the nozzleman radio control over his own pressure and flow.

The total operation requires the pump operator to just engage his pump. The system then starts up, checks all the important truck parameters, and is ready to receive the signals from the nozzlemen to operate the valves by radio control.

This system is designed to be activated, from the cab of the pumper, by the action of the pump being engaged. At this time, the engine speed will increase, until a pre-set pump pressure is obtained. If there is tank water available, the pump pressure will be at any preselected pressure (adjustable from 70 to 300 psi) within ten seconds.

When the nozzleman takes his hand line, he also takes his transmitter, which is color coded to the nozzle, and proceeds to the point of the fire. The nozzle, which we supply is specifically designed to operate with our system, but any standard nozzle will function.

While the system is operating itself, the pump operator is able to go to the hose bed, get the supply line, and attach it to the intake of the pumper. If he decides he needs a hydrant supply, he pushes the Hydrant Open button, and the Radio Controlled Hydrant Valve, which was previously left at the nearest hydrant, will open, supplying the necessary water.

The system computer also monitors the incoming hydrant supply, and, if any time the supply falls less than the pre-set levels, a warning bell will sound, and the water will be taken from the tank.

The controls herein are not limited to fire truck control but may be adapted for many control applications.

It is claimed:

1. New and improved fire fighting communication and control means for fire trucks having tanks,
- hose valves connected to the tanks,
- hoses connected to the hose valves,
- and nozzles connected to the hoses,
- and a driven pump for supplying water to hose valves, hoses and nozzles comprising,
- a computer
- a nozzle mounted transceiver for communication with a nozzle man located at a nozzle,
- automatic clutch drive means responsive to the computer connected to operate the hose control valves,
- and automatic pressure regulating means connected to the pump for maintaining pressure on the hoses.

2. Apparatus as in claim 1 having electrical sensor means for indicating when a tank is approaching an empty state,
- means to connect the tank to a hydrant,
- and means responsive to the sensor means to provide remote control of hydrant valves.

3. Apparatus as in claim 2 having means to measure the water pressure from the hydrant and means responsive to the hydrant pressure to control operation of water tank means including means to automatically refill the tanks.

4. Apparatus as in claim 1 having time delay means connected to the pressure regulating means to make the pressure regulating means insensitive to minor fluctuations in pressure.

5. Apparatus as in claim 1 wherein the nozzle located transceiver has a multiple code transmitter.

6. Apparatus as in claim 1 having at least one additional transceiver on a fire truck.

7. Apparatus as in claim 6 having at least one additional transceiver at another control station.

8. Apparatus as in claim 1 wherein the automatic pressure regulating means comprises, a carburetor having a fuel control, a motor connected to the fuel control, and a potentiometer connected to the fuel control.

9. Apparatus as in claim 1 having digital control of pressures and water flows.

10. Apparatus as in claim 1 having pressure warning means including time delay means.

11. Apparatus as in claim 10 having a flip-flop circuit connected to the warning means.

12. New and improved fire fighting communication and control means for fire trucks having tanks, hose valves connected to the tanks, hoses connected to the hose valves, and nozzles connected to the hoses, and a driven pump for supplying water to hose valves, hoses and nozzles comprising, a computer a nozzle mounted transceiver for communication with a nozzle man located at a nozzle, automatic clutch drive means responsive to the computer connected to operate the hose control valves, and automatic pressure regulating means connected to the pump for maintaining pressure on the hoses, means for indicating when a tank is approaching an empty state, means to connect the tanks to a hydrant and means for remote control of the hydrant valve, having hydrant low pressure sensor means and a tank-to-pump valve connected to be operated by said hydrant low pressure sensor means.

13. Apparatus as in claim 12 wherein the remote valve operating means includes radio means.

14. New and improved fire fighting communication and control means for fire trucks having tanks hose valves connected to the tanks, hoses connected to the hose valves, and nozzles connected to the hoses, and a driven pump for supplying water to hose valves, hoses and nozzles comprising, a computer, a nozzle mounted transceiver for communication with a nozzle man located at a nozzle, automatic clutch drive means responsive to the computer connected to operate the hose control valves, and automatic pressure regulating means connected to the pump for maintaining pressure on the hoses, means for indicating when a tank is approaching an empty state, means to connecte the tanks to a hydrant and means for remote control of the hydrant valve, having hydrant high pressure sensor means, a low volume tank sensor and a tank-to-pump valve connected to be operated by said high pressure sensor means to thereby automatically refill the tank.

15. Apparatus as in claim 14 having analog data means connected to said sensors and means to convert the analog data to digital data to control the valve.

* * * * *